US009280078B2

(12) United States Patent
Higaki

(10) Patent No.: US 9,280,078 B2
(45) Date of Patent: Mar. 8, 2016

(54) CHARGING DEVICE, IMAGE FORMING UNIT AND IMAGE FORMING APPARATUS

(71) Applicant: Oki Data Corporation, Tokyo (JP)

(72) Inventor: Toshimasa Higaki, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/533,626

(22) Filed: Nov. 5, 2014

(65) Prior Publication Data

US 2015/0125184 A1 May 7, 2015

(30) Foreign Application Priority Data

Nov. 6, 2013 (JP) ..... 2013-229965

(51) Int. Cl.
*G03G 15/02* (2006.01)
*G03G 15/16* (2006.01)

(52) U.S. Cl.
CPC ..... *G03G 15/0233* (2013.01); *G03G 15/025* (2013.01); *G03G 15/0208* (2013.01); *G03G 15/0216* (2013.01); *G03G 15/1685* (2013.01); *G03G 2215/021* (2013.01); *G03G 2221/183* (2013.01)

(58) Field of Classification Search
CPC ..... G03G 15/02
USPC ..... 399/176
See application file for complete search history.

(56) References Cited

U.S. PATENT DOCUMENTS

| | | | | |
|---|---|---|---|---|
| 2005/0191081 | A1* | 9/2005 | Muraishi et al. | 399/100 |
| 2006/0039719 | A1* | 2/2006 | Tokumasu et al. | 399/176 |
| 2007/0122180 | A1* | 5/2007 | Miyaji | 399/100 |
| 2007/0172251 | A1* | 7/2007 | Suganuma et al. | 399/100 |
| 2008/0025753 | A1* | 1/2008 | Yamamoto et al. | 399/100 |
| 2008/0247778 | A1* | 10/2008 | Motokawa et al. | 399/159 |
| 2011/0002711 | A1 | 1/2011 | Wada | |
| 2011/0013928 | A1* | 1/2011 | Kawai et al. | 399/100 |
| 2012/0107565 | A1 | 5/2012 | Kuroda et al. | |
| 2013/0028636 | A1* | 1/2013 | Hu et al. | 399/159 |
| 2014/0341608 | A1* | 11/2014 | Nakai et al. | 399/100 |

FOREIGN PATENT DOCUMENTS

| | | | | |
|---|---|---|---|---|
| JP | 2008-015323 | * | 1/2008 | G03G 15/02 |
| JP | 2010-054795 | * | 3/2010 | G03G 15/02 |
| JP | 2010-054795 A | | 3/2010 | |

* cited by examiner

*Primary Examiner* — Clayton E LaBalle
*Assistant Examiner* — Kevin Butler
(74) *Attorney, Agent, or Firm* — Rabin & Berdo, P.C.

(57) ABSTRACT

A charging device includes a charging member that charges a surface of an image bearing body. The charging member includes a rotation shaft applied with a voltage, and a resilient conductive layer provided on an outer circumferential surface of the rotation shaft. The resilient conductive layer charges the surface of the image bearing body. The resilient conductive layer has a plurality of high resistance regions arranged at intervals in an axial direction of the rotation shaft.

15 Claims, 5 Drawing Sheets

FIG. 7

| | | SAMPLE | | | | | | | | | | |
|---|---|---|---|---|---|---|---|---|---|---|---|---|
| | | 1 | 2 | 3 | 4 | 5 | 6 | 7 | 8 | 9 | 10 | 11 |
| BASE POLYMER | EPICHLOROHYDRIN RUBBER (WEIGHT PARTS) | 60 | 80 | 40 | 80 | 40 | 85 | 35 | 60 | 60 | 60 | 60 |
| | DIENE-BASED RUBBER (WEIGHT PARTS) | 40 | 20 | 60 | 20 | 60 | 15 | 65 | 40 | 40 | 40 | 40 |
| SURFACE PROPERTY | SURFACE TREATMENT (UV/COATING) | UV | UV | UV | UV | UV | UV | UV | UV | UV | COATING | UV & COATING |
| | PRESENSE (YES)/ ABSENCE (NO) OF CRACKS | YES | YES | YES | YES | YES | YES | YES | YES (SMALL) | NO | NO | YES |
| | MINIMUM VALUE OF CRACK DEPTHS (μM) | 80 | 40 | 100 | 20 | 160 | 30 | 120 | 150 | 0 | 0 | 60 |
| EVALUATION RESULT | AT START OF PRINTING OPERATION | ○ | ○ | ○ | ○ | ○ | ○ | × | ○ | ○ | ○ | × |
| | AT END OF CONTINUOUS PRINTING OPERATION | ○ | ○ | ○ | ○ | ○ | × | | × | × | × | |

CHARGING DEVICE, IMAGE FORMING UNIT AND IMAGE FORMING APPARATUS

BACKGROUND OF THE INVENTION

The present invention relates to a charging device used in an electrophotographic process, and relates to an image forming unit and an image forming apparatus using the charging device.

In image forming apparatuses using an electrophotography process such as a printer, copier, facsimile or multifunction peripheral, a charging device is used to uniformly charge a surface of a photosensitive drum. There are several types of charging devices. A widely used charging device (i.e., a contact-charging type) includes a charging roller contacting the surface of the photosensitive drum and applied with a direct voltage.

The charging device of the contact-charging type has a disadvantage that a charging potential is likely to be uneven. To be more specific, the charging potential is likely to be uneven in an axial direction of the charging roller. Therefore, it has been proposed to form polishing grooves on a surface of the charging roller in a rotating direction of the charging roller to thereby reduce unevenness of the charging potential in the axial direction.

Further, as printing is repeatedly performed, the charging roller gradually becomes dirty. Therefore, it has been proposed to provide a cleaning roller that contacts and cleans the surface of the charging roller (see, for example, Japanese Laid-open Patent Publication No. 2010-54795).

However, in the conventional art, the surface of the charging roller may become worn by contact with the cleaning roller. In such a case, the charging potential on the surface of the photosensitive drum may become uneven, and printing quality may be degraded.

SUMMARY OF THE INVENTION

An aspect of the present invention is intended to prevent degradation of printing quality.

According to an aspect of the present invention, there is provided a charging device including a charging member that charges a surface of an image bearing body. The charging member includes a rotation shaft applied with a voltage, and a resilient conductive layer provided on an outer circumferential surface of the rotation shaft. The resilient conductive layer charges the surface of the image bearing body. The resilient conductive layer has a plurality of high resistance regions arranged at intervals in an axial direction of the rotation shaft.

With such a configuration, degradation of printing quality can be prevented.

BRIEF DESCRIPTION OF THE DRAWINGS

In the attached drawings:

FIG. 7 shows compositions and evaluation results of the charging rollers of Samples 1 through 11.

DETAILED DESCRIPTION OF THE PREFERRED EMBODIMENT

Hereinafter, the embodiment of the present invention will be described with reference to the attached drawings.

<Image Forming Apparatus>

Figure 1:
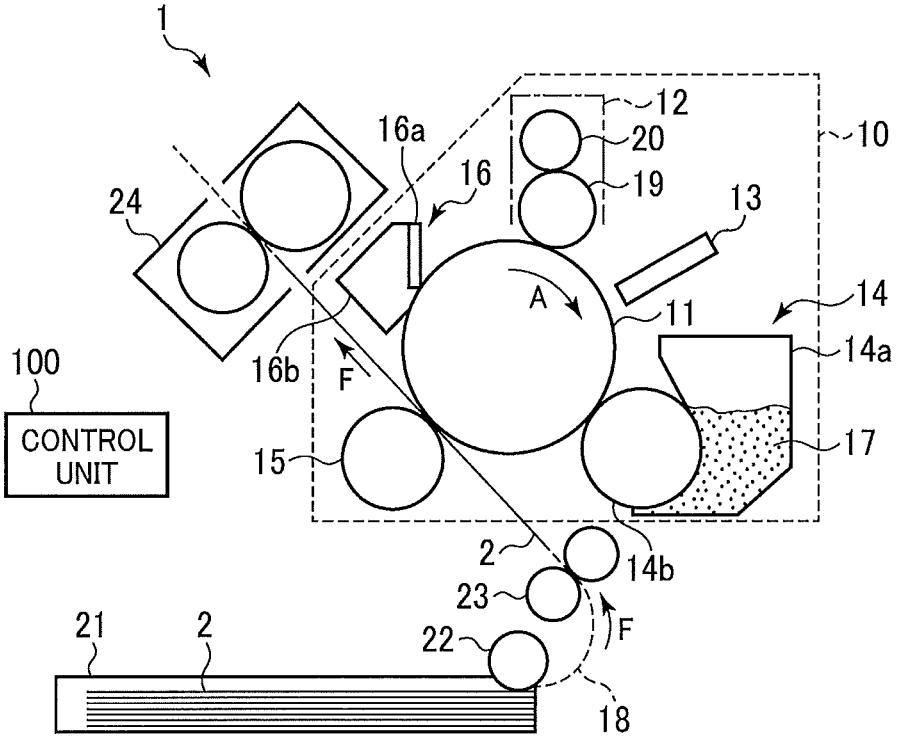
FIG. 1 is a schematic sectional view of an image forming apparatus according to an embodiment of the present invention.

FIG. 1 is a schematic sectional view of a printer 1 as an image forming apparatus according to the embodiment of the present invention. The printer 1 includes a control unit 100, a feeding tray 21, a feeding roller 22, a pair of conveying rollers 23, an image forming unit 10 and a fixing device 24. The control unit 100 receives print command and image information from a host device via an interface unit (not shown), converts the received image information into image data signal, and performs image forming operation (i.e., printing operation). The feeding tray 21 stores a stack of media (i.e., recording sheets) 2 therein. The feeding roller 22 feeds the media 2 one by one out of the feeding tray 21. The conveying rollers 23 convey the medium 2 to the image forming unit 10. The image forming unit 10 forms a latent image based on the image data signal, develops the latent image using a toner (i.e., a developer) to form a toner image (i.e., a developer image), and transfers the toner image to the medium 2. The fixing device 24 fixes the toner image to the medium 2.

Hereinafter, the printer 1 will be described as including only one image forming unit 10 to form a single color image for convenience of explanation. However, it is also possible that the printer 1 includes a plurality of image forming units 10 to form a color image.

The image forming unit 10 is configured to form a toner image and transfer the toner image to the medium 2. The image forming unit 10 includes a charging device 12, an exposure device 13, a developing device 14, a transfer device 15 and a cleaning device 16.

The photosensitive drum 11 as an image bearing body has a surface to be charged by the charging device 12. The surface of the photosensitive drum 11 is exposed with light emitted by the exposure device 13, and a latent image is formed on the surface of the photosensitive drum 11.

The photosensitive drum 11 includes a conductive supporting body made of aluminum, stainless steel and the like, a charge generation layer formed on the conductive supporting body, and a charge transport layer formed on the charge generation layer.

The charge generation layer is a dispersion layer in which fine particles of charge generation substance are bound using binder resin. As the charge generation substance of the charge generation layer, it is possible to use various organic pigments, dyes and the like. For example, it is possible to use phthalocyanine compounds such as metal phthalocyanine in which metal, metal oxide or metal chloride thereof (such as copper indium chloride, gallium chloride, tin, oxytitanium, zinc and vanadium) is coordinated and non-metal phthalocyanine, or azo pigment such as monoazo, bisazo, trisazo and poly azo compounds.

As the binder resin of the charge generation layer, it is possible to use, for example, polyester resin, polyvinyl acetate, polyacrylic ester, polymethacrylic acid ester, polyester, polycarbonate, polyvinyl acetoacetal, polyvinyl propional, polyvinyl butyral, phenoxy resin, epoxy resin, urethane resin, cellulose ester, cellulose ether and the like.

The charge transport layer is mainly formed of charge transport substance and binder resin. As the charge transport substance of the charge transport layer, it is possible to use, for example, electron donors such as heterocyclic compounds (such as carbazole, indole, imidazole, oxazole, pyrazole, oxadiazole, pyrazoline or thiadiazole), aniline derivatives, hydrazone compounds, aromatic amine derivatives, stilbene derivatives, or polymers having a main chain or side chains comprising one of the above-mentioned compounds.

As the binder resin of the charge transport layer, it is possible to use, for example, vinyl polymer (such as polycarbonate, polymethylmethacrylate, polystyrene and polyvinyl chloride), polyester, polyester carbonate, polysulphone, polyimide, phenoxy, epoxy, silicon resin, copolymer of these materials, a partial cross-linking hardened material or the like, alone or in combination. In particular, polycarbonate is suitable. In addition, as needed, various additives such as antioxidant, sensitizer and the like may be added.

The conductive supporting body of the photosensitive drum 11 is formed of an aluminum tube. A surface of the aluminum tube is subjected to alumite treatment. The charge generation layer and the charge transport layer are laminated on the conductive supporting body. An outer diameter of the photosensitive drum 11 is 30.0 mm. The charge generation layer contains phthalocyanine as the charge generation substance, and polyvinyl acetoacetal-based resin as the binder resin. The charge transport layer contains hydrazine-based compound as the charge transport substance, and polycarbonate-based resin (added with antioxidant) as the binder resin. A thickness of the charge transport layer is 15 μm.

The charging device 12 includes a charging roller 19 and a cleaning roller 20.

The charging roller 19 as a charging member is provided so as to contact the photosensitive drum 11, and charges a surface of the photosensitive drum 11. In this regard, the charging roller 19 may be provided in the vicinity of the photosensitive drum 11 in a non-contact manner. The charging roller 19 and the cleaning roller 20 will be described later.

The exposure device 13 (i.e., an exposure unit) is disposed downstream of the charging roller 19 in a rotating direction of the photosensitive drum 11 indicated by an arrow A. The exposure device 13 includes a light source such as an LED (Light Emitting Diode) head. The exposure device 13 emits light to the surface of the photosensitive drum 11 in accordance with the image data signal (to cause a charging potential of an exposed part of the photosensitive drum 11 to decrease) to thereby form a latent image on the surface of the photosensitive drum 11.

The developing device 14 (i.e., a developing unit) is disposed downstream of the exposure device 13 in the rotating direction of the photosensitive drum 11 indicated by the arrow A. The developing device 14 develops the latent image on the surface of the photosensitive drum 11 to form a toner image. The developing device 14 includes a toner storage portion **14*a* for storing a toner 17 therein, and a developing roller 14*b*** as a developer bearing body.

The toner storage portion **14*a* (i.e., a developer storage portion) stores the toner 17, and supplies the toner 17 to the surface of the developing roller 14*b* so that a toner layer is formed on the developing roller 14*b***.

The developing roller **14*b*** (i.e., a developer bearing body) includes a conductive supporting body and a conductive layer provided on an outer circumferential surface of the conductive supporting body. As needed, a surface of the conductive supporting body may be subjected to surface treatment or coating.

The conductive supporting body is connected to a developing bias power source (not shown), and is applied with, for example, a direct voltage of −250V (i.e., a developing voltage) for developing the latent image.

The conductive supporting body of the developing roller **14*b* is formed of a metal shaft of free-cutting steel (SUM). The conductive layer of the developing roller 14*b*** is formed of urethane rubber (as a main component) added with carbon black (Ketjen black) as electron conductive agent. A resistance of the conductive layer is controlled by adjusting adding amount of carbon black. Further, a surface-treatment liquid containing isocyanate compound and carbon black (acethylene black) is coated on the surface of the conductive layer.

The toner 17 as a developer includes toner particles mixed with external additives. The toner 17 used in this embodiment is a non-magnetic single component negatively-chargeable polymerization toner. To be more specific, the toner 17 is obtained by forming the toner particles by mixing styrene-acrylonitrile copolymer, coloring agent and wax by emulsion polymerization method and by adding fine particles of silica and titanium oxide (i.e., external additives) to the toner particles.

A degree of circularity of the toner particles is in a range from 0.94 through 0.98. A mean particle diameter of the toner particles is in a range from 5.5 to 7.0 μm. A mean particle diameter of the external additives is in a range from 50 to 200 nm.

The transfer device 15 includes a transfer roller as a transfer member provided so as to contact the photosensitive drum 11, and transfers the toner image from the surface of the photosensitive drum 11 to the medium 2. The transfer roller includes a conductive supporting body and a conductive layer formed on an outer circumferential surface of the conductive supporting body. The conductive supporting body is formed of a shaft of free-cutting steel (SUM). The conductive layer is formed of rubber foam body. The rubber foam body is obtained by mixing epichlorohydrin rubber and acrylonitrile-butadiene rubber. A resistance value of the rubber foam body is controlled by adjusting a compounding ratio of epichlorohydrin rubber in the rubber foam body.

The rubber foam body has foam cells whose mean cell diameter is in a range from 50 to 300 μm. An asker-C hardness of the rubber foam body is approximately 35 degrees.

The cleaning device 16 as a developer cleaning unit is provided downstream of the transfer device 15 in the rotating direction of the photosensitive drum 11 indicated by the arrow A. The cleaning device 16 scrapes off and removes a residual toner 17 (i.e., the toner 17 remaining on the surface of the photosensitive drum 11 after transferring of the toner image) and contamination adhering to the surface of the photosensitive drum 11.

The cleaning device 16 includes a cleaning blade **16*a* and a waste toner storage portion 16*b***.

The cleaning blade **16*a* includes a supporting body and a resilient blade member. An end of the blade member is fixed to the supporting body, and the other end of the blade member contacts the surface of the photosensitive drum 11 so as to scrape off the residual toner 17 and the contamination from the surface of the photosensitive drum 11. The supporting body of the cleaning blade 16***a* is formed of electrolytic zinc-coated steel sheet (SECC). The blade member of the cleaning blade 16*a* is formed of polyurethane.

The waste toner storage portion 16*b* stores the residual toner 17 (i.e., a waste toner) scraped off from the surface of the photosensitive drum 11 by the cleaning blade 16*a*.

The cleaning device 16 is able to recover substantially all of the residual toner 17 adhering to the surface of the photosensitive drum 11. In this regard, some of the external additives adhering to the surface of the photosensitive drum 11 are recovered by the cleaning device 16, but some of the external additives may pass through the cleaning device 16 (i.e., are not recovered by the cleaning device 16). Among the external additives having passed through the cleaning device 16, the positively charged external additives and the external additives having large adhesion force may adhere to the charging roller 19.

The feeding tray 21 is disposed below the image forming unit 10, and stores the medium 2.

The feeding roller 22 separates the media 2 stored in the feeding tray 21 one by one, and feeds each medium 2 into a medium conveying path 18 indicated by a broken line.

The conveying rollers 23 are disposed downstream of the feeding roller 22 along the medium conveying path 18. The conveying rollers 23 convey the medium 2 (having been fed by the feeding roller 22) to the image forming unit 10.

The fixing device 24 is disposed downstream of the image forming unit 10 in a conveying direction of the medium 2 indicated by an arrow F along the medium conveying path 18. The fixing device 24 applies heat and pressure to the medium 2 so as to fix the toner image to the medium 2.

The control unit 100 includes a control part such as a CPU (Central Processing Unit) and a storage part such as a memory, and controls entire operation of the printer 1 based on control program (software) stored in the storage unit.

<Charging Device>

Figure 2:
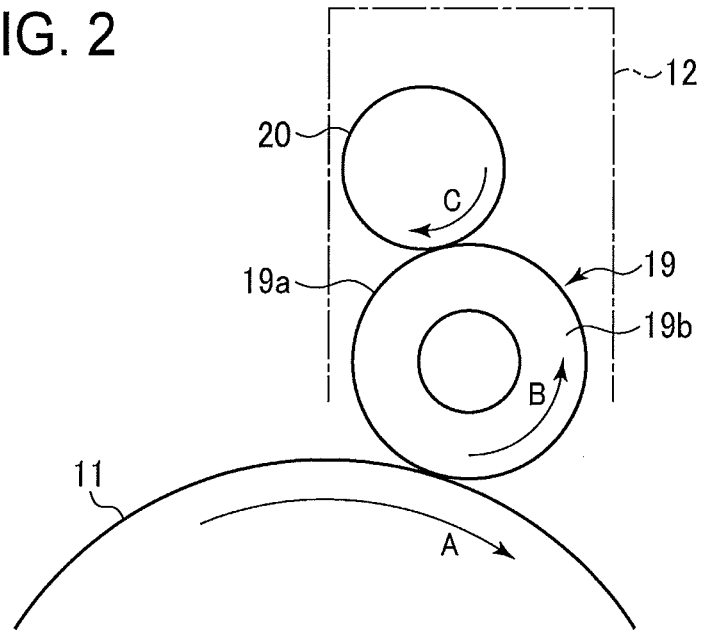
FIG. 2 is a schematic sectional view of a charging device according to the embodiment of the present invention.

Next, the charging device 12 will be described with reference to FIG. 2. FIG. 2 is a schematic sectional view showing the charging device 12 according to the embodiment of the present invention.

As shown in FIG. 2, the charging roller 19 includes a conductive supporting body 19*a* and a resilient conductive layer 19*b* formed on an outer circumferential surface of the conductive supporting body 19*a*.

The conductive supporting body 19*a* (i.e., a rotation shaft) is connected to a charging bias power source (not shown), and is applied with a direct voltage (i.e., a charging voltage).

The resilient conductive layer 19*b* contains base polymer which is a mixture of epichlorohydrin rubber and diene-based rubber. The base polymer is added with, for example, thiourea cross-linking agent and promoter for causing cross-linking of epichlorohydrin rubber, and at least a kind of cross-linking agent (composed of sulfur and sulfur-containing cross-linking agent) and sulfur-containing promoter for causing cross-linking of diene-based rubber.

Further, at least a kind of additives such as cross-linking assistant, conductive agent, acid acceptor, antioxidizing agent, antistaling agent, processing aid, filler, pigment, neutralizer and bubble prevention agent may be added to the base polymer.

As epichlorohydrin rubber, it is possible to use, for example, epichlorohydrin homopolymer (CO), epichlorohydrin-ethylene oxide copolymer (ECO), epichlorohydrin/allyl glycidyl ether copolymer (GCO), epichlorohydrin/ethylene oxide/allyl glycidyl ether (GECO), copolymer of epichlorohydrin, propylene oxide and allyl glycidyl ether, copolymer of epichlorohydrin, ethylene oxide, propylene oxide and allyl glycidyl ether, alone or in combination. In this embodiment, epichlorohydrin rubber of the resilient conductive layer 19*b* is ECO.

As diene-based rubber, it is possible to use, for example, acrylonitrile-butadiene rubber (NBR), chloroprene rubber (CR), butadiene rubber (BR), styrene-butadiene rubber (SBR), isoprene rubber (IR) or natural rubber, alone or in combination. In this embodiment, NBR is a main component of diene-based rubber of the resilient conductive layer 19*b*.

<Characteristics of Charging Roller>

Next, electrical characteristics the charging roller 19 will be described. A resistance value of the resilient conductive layer 19*b* of the charging roller 19 relates to unevenness in charging potential and charging failure. Generally, if the resistance value of the resilient conductive layer 19*b* is too high, a variation in the resistance value of the resilient conductive layer 19*b* is likely to influence a distribution of electric charge on the surface of the resilient conductive layer 19*b*. In such a case, the charging potential on the surface of the photosensitive drum 11 may become uneven, and image defect is likely to occur. In contrast, if the resistance value of the resilient conductive layer 19*b* is too low, leakage of electric charge is likely to occur at scratches on the surface of the photosensitive drum 11, which may cause charging failure and result in image defect.

For these reasons, there is an appropriate range of the resistance value of the resilient conductive layer 19*b*. For example, the appropriate range of the resistance value of the resilient conductive layer 19*b* is from $10^6$ to $10^9\Omega$. In order to obtain the appropriate range of the resistance value, the resilient conductive layer 19*b* is formed using ion conductive material, ion conductive agent, carbon black, metal oxide or the like. The resilient conductive layer 19*b* may be formed using either electron conductive material or ion conductive material.

In this regard, variation in resistance value of the resilient conductive layer 19*b* is likely to influence the unevenness of the charging potential of the photosensitive drum 11. Further, ion conductive material is more excellent than electron conductive material in effect of stabilizing the resistance value. Therefore, in this embodiment, the resilient conductive layer 19*b* is formed using ion conductive material for reducing the unevenness of the resistance value.

Therefore, in order to obtain the ion conductivity, conductive agent, carbon black, metal oxide and the like are added to epichlorohydrin rubber containing ethylene oxide so that the resistance value of the resilient conductive layer 19*b* is adjustable.

Further, NBR as polar rubber is used as the diene-based rubber so that the resistance value of the resilient conductive layer 19*b* is adjustable.

Figure 3:
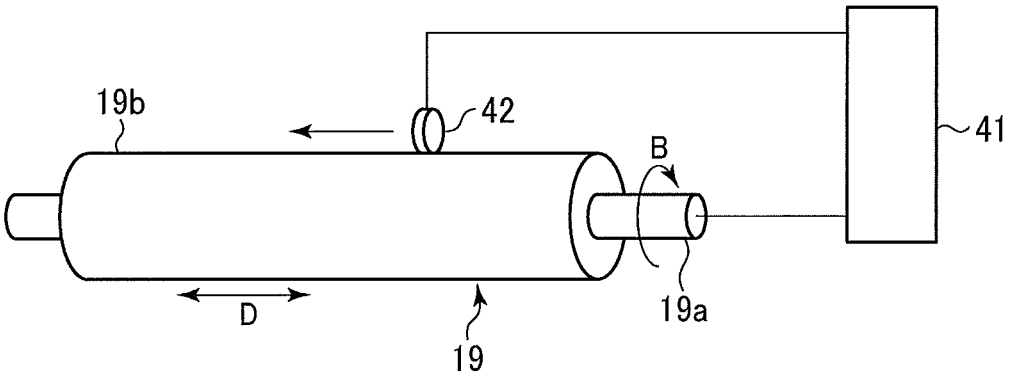
FIG. 3 is an explanation view for explaining a measuring method of a resistance value of a charging roller according to the embodiment of the present invention.

Next, the measurement of the resistance value of the charging roller 19 will be described. FIG. 3 is an explanation view for explaining a measuring method of the resistance value of the charging roller 19 according to the embodiment of the present invention.

In FIG. 3, the resistance value of the charging roller 19 is measured using a resistance measuring instrument 41 (i.e., "High Resistance Meter 4339B" manufactured by Agilent Technologies Incorporated) and a bearing 42. The bearing 42 is formed of stainless steel (SUS), and has a width of 2.0 mm and an outer diameter of 6.0 mm.

A terminal of the resistance measuring instrument 41 is brought into contact with the conductive supporting body 19*a*, and the other terminal of the resistance measuring instrument 41 is connected to the bearing 42. The bearing 42 is biased against the surface of the resilient conductive layer 19*b* with a force of 10 gf. In this state, the charging roller 19 is rotated as shown by an arrow B in this state, and the resistance value of the charging roller 19 is measured during the rotation of the charging roller 19.

Generally, the resistance value of the charging roller 19 changes depending on a temperature, humidity and applied voltage. In this embodiment, the resistance value of the charging roller 19 is measured at a temperature of 20° C. and humidity of 50% RH. A direct voltage of −500V is applied to the conductive supporting body 19*a* side.

Next, structural characteristics of the charging roller 19 will be described with reference to FIG. 2.

In order to cause discharge from the resilient conductive layer 19*b* for charging the surface of the photosensitive drum 11 contacting the surface of the resilient conductive layer 19*b*, it is necessary to form a minute gap between the surface of the resilient conductive layer 19*b* and the surface of the photosensitive drum 11 to ensure a region contributing to discharge according to Paschen's law. Therefore, in order to obtain an appropriate nip (i.e., a contacting state) between the surface of the resilient conductive layer 19*b* and the surface of the photosensitive drum 11, it is preferred that the Asker-C hardness of the resilient conductive layer 19*b* is lower than or equal to 85 degrees, and it is more preferred that the Asker-C hardness of the resilient conductive layer 19*b* is lower than or equal to 80 degrees.

Figure 4:
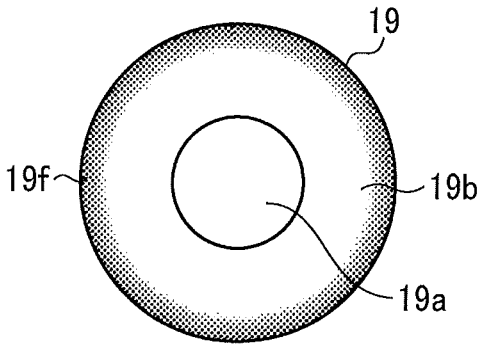
FIG. 4 is a schematic sectional view showing the charging roller according to the embodiment of the present invention.

FIG. 4 is a schematic cross sectional view of the charging roller 19 according to the embodiment of the present invention.

An oxide film 19*f* (i.e., a protection film) is formed on the surface of the resilient conductive layer 19*b*. The oxide film 19*f* is formed by irradiating the surface of the resilient conductive layer 19*b* with UV (Ultra-Violet) rays while rotating the charging roller 19. That is, UV irradiation on the surface of the resilient conductive layer 19*b* causes oxidization of double-bonds of diene-based rubber contained in the resilient conductive layer 19*b*.

The oxide film 19*f* is formed by the UV irradiation, and therefore there is no distinct border between the oxide film 19*f* and other portions of the resilient conductive layer 19*b*. The oxide film 19*f* is thicker than at least a depth of cracks 16*c* (FIG. 6) described later.

The formation of the oxide film 19*f* on the surface of the resilient conductive layer 19*b* provides following advantages. Firstly, the oxide film 19*f* prevents bloom or bleed, i.e., a phenomenon that low-molecular-weight component is precipitated from the resilient conductive layer 19*b*. That is, the surface of the photosensitive drum 11 can be prevented from being contaminated with precipitate.

Secondly, the oxide film 19*f* contributes to reducing the amounts of the residual toner 17 and the external additives remaining on the surface of the photosensitive drum 11 and adhering to the resilient conductive layer 19*b* from the photosensitive drum 11. Further, even if the toner 17 and the external additives adhere to the resilient conductive layer 19*b*, the oxide film 19*f* makes it easy to remove the toner 17 and the external additives from the resilient conductive layer 19*b* by the cleaning roller 20. Therefore, filming otherwise caused by the toner 17 and the external additives adhering to the surface of the resilient conductive layer 19*b* can be prevented.

Thirdly, the oxide film 19*f* contributes to reducing a friction coefficient between the resilient conductive layer 19*b* and the cleaning roller 20, and therefore wear by contact between the resilient conductive layer 19*b* and the cleaning roller 20 can be reduced.

Figure 5:
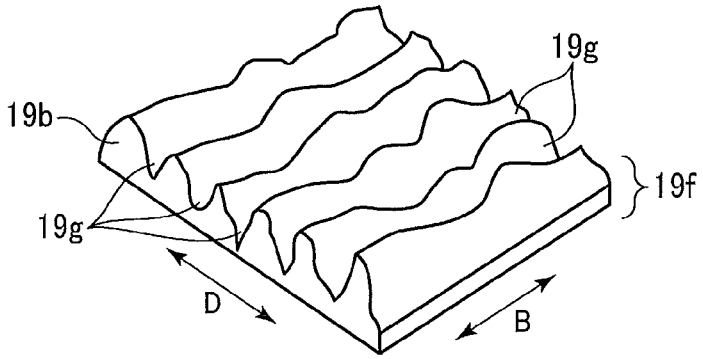
FIG. 5 is an explaining view for explaining a surface of a resilient conductive layer of the charging roller according to the embodiment of the present invention.

FIG. 5 is a schematic view showing the surface of the resilient conductive layer 19*b* of the charging roller 19 according to the embodiment of the present invention.

As shown in FIG. 5, a plurality of grooves 19*g* (more specifically, polishing grooves) are formed on the surface of the resilient conductive layer 19*b* of the charging roller 19. The polishing grooves 19*g* extend in a rotating direction of the charging roller 19 indicated by the arrow B (FIGS. 2, 3 and 5), and are arranged at intervals in an axial direction of the charging roller 19 as shown by an arrow D. The polishing grooves 19*g* are formed by tape polishing. With such polishing grooves 19*g*, the resilient conductive layer 19*b* has a predetermined surface roughness.

A maximum height roughness Ry (JIS B0601: 1994) of the resilient conductive layer 19*b* is preferably in a range from 1 to 40 μm, and more preferably in a range from 3 to 30 μm according to Paschen's law. This range varies depending on the applied voltage, use environment or the like.

In this embodiment, the surface roughness (i.e., the maximum height roughness Ry) of the resilient conductive layer 19*b* is measured using a surface roughness measuring instrument "Surf coder SE 3500" (manufactured by Kosaka Laboratory Limited) and a detector "PU-DJ2S" (manufactured by Kosaka Laboratory Limited).

Figure 6:
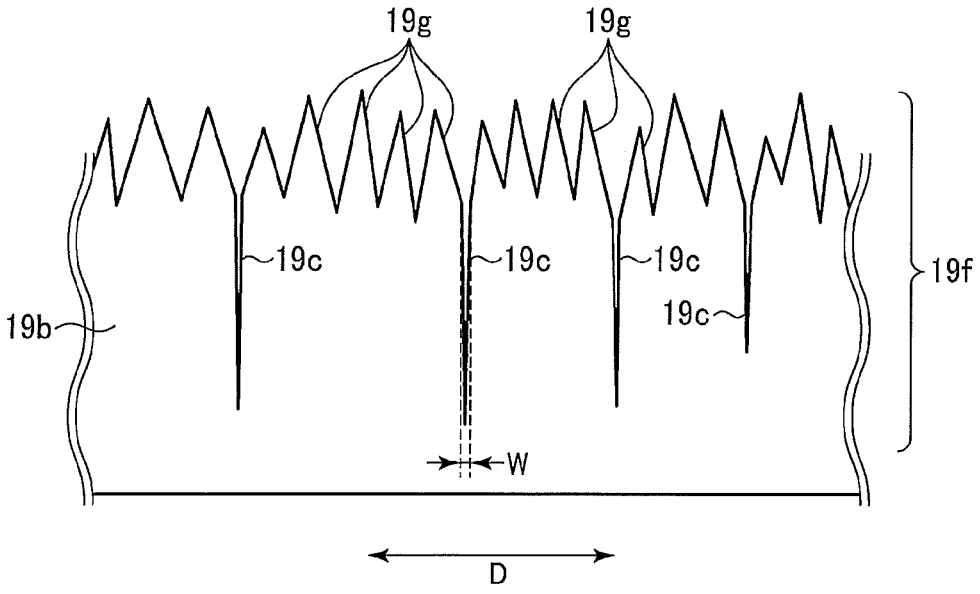
FIG. 6 is a schematic sectional view showing the surface of the resilient conductive layer of the charging roller according to the embodiment of the present invention.

FIG. 6 is an explanation view for explaining the surface of the resilient conductive layer 19*b* of the charging roller 19 according to the embodiment of the present invention.

When the surface of the resilient conductive layer 19*b* is subjected to the UV irradiation for a long time, small cracks 19*c* (i.e., high resistance regions) are formed on the surface of the resilient conductive layer 19*b*. To be more specific, the cracks 19*c* are formed at valleys of the polishing grooves 19*g*. The cracks 19*c* extend in the rotating direction of the charging roller 19 indicated by the arrow B, and are arranged at intervals in the axial direction of the charging roller 19 as indicated by the arrow D. In this embodiment, the cracks 19*c* are utilized to achieve a desired effect. In Comparison Example (Sample 10) described later, a coating film is formed on the resilient conductive layer 19*b* by dipping the charging roller 19 in surface treatment liquid and drying the charging roller 19, instead of the UV irradiation.

In this regard, a surface resistance of the resilient conductive layer 19*b* is increased by the provision of the oxide film 19*f*.

<Cleaning Roller>

Referring back to FIG. 2, the cleaning roller 20 is provided in contact with or in the vicinity of the surface of the resilient conductive layer 19*b*. It is possible that the cleaning roller 20 rotates following a rotation of the charging roller 19. It is also possible that the cleaning roller 20 is driven to rotate at a different speed from the charging roller 19 so that the surface of the cleaning roller 20 slides on the surface of the charging roller 19.

In the case where the cleaning roller 20 slides on the surface of the resilient conductive layer 19*b*, if a difference in circumferential speed (i.e., a circumferential speed difference) between the cleaning roller 20 and the charging roller 19 is too small, a cleaning performance may decrease. In contrast, if the circumferential speed difference is too large, the surface of the resilient conductive layer 19*b* may be worn, and adhering substances are pressed against the surface of the resilient conductive layer 19*b* to cause filming. Therefore, it is necessary to adjust the circumferential speed difference based on the amounts of the toner 17 and the external additives remaining on the photosensitive drum 11 and adhering to the resilient conductive layer 19*b* from the photosensitive drum 11.

In this regard, a ratio of the circumferential speed of the cleaning roller 20 to the circumferential speed of the charging roller 19 is preferably in a range from 0.8 to 1.25.

In this embodiment, the cleaning roller 20 is provided in contact with the charging roller 19. The ratio of the circumferential speed of the cleaning roller 20 to the circumferential speed of the charging roller 19 is set to 0.9.

Further, in this embodiment, the cleaning roller 20 includes a shaft body having an outer diameter of 6 mm, and a urethane foam having a thickness of 1.5 mm formed on an outer circumferential surface of the shaft body. An outer diameter of the cleaning roller 20 is 9 mm.

<Experiments>

In order to suppress degradation of printing quality, the charging rollers 19 of eleven samples were produced while varying material and surface treatment method of the resilient conductive layer 19*b*. The charging rollers 19 of these samples will be described with reference to FIGS. 3 through 6.

FIG. 7 shows components and evaluation results of the charging rollers 19 of eleven samples, i.e., Samples 1 through 11. To be more specific, FIG. 7 shows weight parts of epichlorohydrin rubber and diene-based rubber (which constitute the base polymer) contained in the resilient conductive layer 19*b*, kinds of surface treatment (i.e., UV irradiation or coating), presence/absence of the cracks 19*c*, and a depth of the cracks 19*c*. FIG. 7 further shows evaluation results at a start of printing operation and at an end of continuous printing operation. Evaluation methods will be described later.

First, a common structure of the charging rollers 19 of Samples 1 through 11 will be described. The conductive supporting body 19*a* of the charging roller 19 was made of a metal shaft body formed of free-cutting steel (SUM), and had an outer diameter of 6 mm.

The resilient conductive layer 19*b* contained 60 weight parts of epichlorohydrin rubber (composed of epichlorohydrin-ethylene oxide copolymer (ECO)) and 40 weight parts of diene-based rubber (mainly composed of NBR). Further, necessary additives (such as cross-linking agent, cross-linking assistant and acid acceptor) of appropriate amounts were added to epichlorohydrin rubber and diene-based rubber.

The resulting material was then kneaded, was extruded by an extrusion molder into a tubular shape having an outer diameter of 13 mm and inner diameter of 5.5 mm, and was steam vulcanized at 150° C. for 3 hours. The resulting body (i.e., a tubular body) was fit to the conductive supporting body 19*a*, and was sintered in an oven for 150° C. for 1 hour. Then, the resulting body (i.e., a sintered body having a roller shape) was cooled to a room temperature.

Then, an outer circumferential surface of the resulting body was polished using a grinding stone. Then, polishing chips were removed, and the outer circumferential surface of the polished body was cleaned. Then, the resulting body (i.e., a polished body) was further polished by wet tape polishing (i.e., final polishing) so as to obtain the resilient conductive layer 19*b* (fitted to the conductive supporting body 19*a*) having an outer diameter of 12 mm. As a result, the charging roller 19 was obtained.

Next, the charging rollers 19 of Samples 1 through 11 will be described.

<Sample 1>

The charging roller 19 of Sample 1 was obtained by forming the oxide film 19*f* on the surface of the resilient conductive layer 19*b* by the UV irradiation so that small cracks 19*c* (i.e., high resistance regions) were formed at valleys of the polishing grooves 19*g* as shown in FIG. 6. That is, a plurality of cracks 19*c* extending in the rotating direction of the charging roller 19 were formed on the surface of the resilient conductive layer 19*b* by the UV irradiation of the resilient conductive layer 19*b*.

The UV irradiation was performed using a metal halide lamp (i.e., a UV light source). An output of the UV light source was set to 120 W/cm, and a distance (i.e., a UV irradiation distance) from the UV light source to the resilient conductive layer 19*b* was set to 50 mm. A time for UV irradiation (i.e., a UV irradiation time) was set to 20 minutes.

Figure 8:
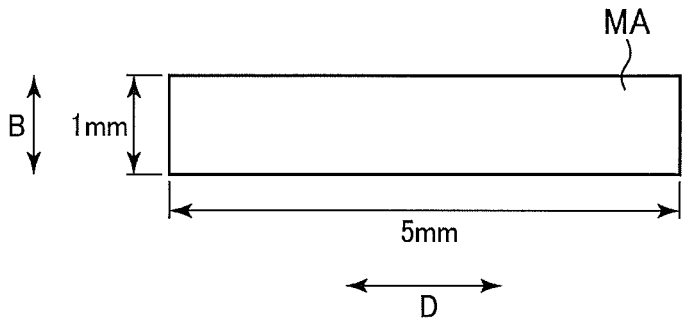
FIG. 8 is a schematic view showing a measurement area for measuring depths of cracks on the surface of the resilient conductive layer of the charging roller.

The depths of cracks 19*c* were determined as follows. FIG. 8 is a schematic view showing a measurement area MA for measuring the depths of the cracks 19*c*. The depths of the cracks 19*c* in the measurement area MA of 5 $mm^2$ on the surface of the resilient conductive layer 19*b* were measured by the above described surface roughness measuring instrument. The measurement area MA had a length of 1 mm in the rotating direction of the charging roller 19 indicated by the arrow B, and a length of 5 mm in the axial direction of the charging roller 19 indicated by the arrow D. Then, among the measured cracks 19*c* in the measurement area MA, five cracks 19*c* from the deepest one were selected. Among the selected five cracks 19*c*, a depth of the shallowest crack 19*c* was defined as a minimum depth per unit area (1 $mm^2$). The minimum depth of the crack 19*c* per unit area (1 $mm^2$) is also referred to as a "minimum value of crack depths".

Regarding the charging roller 19 of Sample 1, the minimum value of the crack depths was 80 μm.

Further, a width between the cracks 19*c* in the axial direction D (indicated by an arrow W in FIG. 6) was less than or equal to 80 μm at its widest part. Each crack 19*c* had a length in the rotating direction (indicated by the arrow B) in a range from several tens μm to several hundreds μm.

<Sample 2>

The charging roller 19 of Sample 2 was different from the charging roller 19 of Sample 1 in composition ratio of epichlorohydrin rubber and diene-based rubber contained in the resilient conductive layer 19*b*. The resilient conductive layer 19*b* of the charging roller 19 of Sample 2 contained 80 weight parts of epichlorohydrin rubber and 20 weight parts of diene-based rubber. The minimum value of the crack depths was 40 μm.

<Sample 3>

The charging roller 19 of Sample 3 was different from the charging roller 19 of Sample 1 in composition ratio of epichlorohydrin rubber and diene-based rubber contained in the resilient conductive layer 19*b*. The resilient conductive layer 19*b* of the charging roller 19 of Sample 3 contained 40 weight parts of epichlorohydrin rubber and 60 weight parts of diene-based rubber. The minimum value of the crack depths was 100 μm.

<Sample 4>

The charging roller 19 of Sample 4 was different from the charging roller 19 of Sample 2 in that the UV irradiation distance was set to 100 mm and the UV irradiation time was set to 15 minutes. The minimum value of the crack depths was 20 μm.

<Sample 5>

The charging roller 19 of Sample 5 was different from the charging roller 19 of Sample 3 in that the UV irradiation distance was set to 20 mm and the UV irradiation time was set to 30 minutes. The minimum value of the crack depths was 160 μm.

<Sample 6>

The charging roller 19 of Sample 6 was different from the charging roller 19 of Sample 1 in composition ratio of epichlorohydrin rubber and diene-based rubber contained in the resilient conductive layer 19*b*. The resilient conductive layer 19*b* of the charging roller 19 of Sample 6 contained 85 weight parts of epichlorohydrin rubber and 15 weight parts of diene-based rubber. The minimum value of the crack depths was 30 μm.

<Sample 7>

The charging roller 19 of Sample 7 was different from the charging roller 19 of Sample 1 in composition ratio of epichlorohydrin rubber and diene-based rubber contained in the resilient conductive layer 19*b*. The resilient conductive layer 19*b* of the charging roller 19 of Sample 7 contained 35 weight parts of epichlorohydrin rubber and 65 weight parts of diene-based rubber. The minimum value of the crack depths was 120 μm.

<Sample 8>

The charging roller 19 of Sample 8 was different from the charging roller 19 of Sample 1 in that the UV irradiation time was set to 10 minutes so as to reduce the depths of the cracks 19*c*. The minimum value of the crack depths was 15 μm.

<Sample 9>

The charging roller 19 of Sample 9 was different from the charging roller 19 of Sample 1 in that the UV irradiation time was set to 5 minutes so as not to form cracks 19*c* on the surface of the resilient conductive layer 19*b*.

<Sample 10>

The charging roller 19 of Sample 10 was different from the charging roller 19 of Sample 1 in a surface treatment of the resilient conductive layer 19*b*. The resilient conductive layer 19*b* of the charging roller 19 of Sample 10 was not subjected to the UV irradiation after being polished by tape polishing and being cleaned. Instead, a coating film was formed on the resilient conductive layer 19*b* by impregnating the charging roller 19 in surface treatment liquid and then drying the charging roller 19. The surface treatment liquid was mixture of 100 weight parts of ethyl acetate as organic solvent, and 20 weight parts of hexamethylene diisocyanate (HDI) as isocyanate compound.

The surface treatment was performed by impregnating the charging roller 19 in the surface treatment liquid for 30 seconds so that the isocyanate compound and the organic solvent adhered to and permeated into the surface of the resilient conductive layer 19*b*. Then, the charging roller 19 was taken out from the surface treatment liquid, and was dried in an oven at 120° C. for 1 hour so that the organic solvent was evaporated. The isocyanate compound remained on the surface of the resilient conductive layer 19*b*, and was hardened. In this way, a coating film was formed on the surface of the resilient conductive layer 19*b*.

The charging roller 19 of Sample 10 was not subjected to the UV irradiation, and therefore no crack was formed on the surface of the resilient conductive layer 19*b*.

<Sample 11>

The charging roller 19 of Sample 11 was different from the charging roller 19 of Sample 1 in surface treatment of the resilient conductive layer 19*b*. The resilient conductive layer 19*b* of the charging roller 19 of Sample 11 was subjected to the UV irradiation, and then a coating film was formed on the resilient conductive layer 19*b* by impregnating the charging roller 19 in the surface treatment liquid and drying the charging roller 19 as described with respect to Sample 10.

In this way, the cracks 19*c* were formed on the surface of the resilient conductive layer 19*b* of the charging roller 19 of Sample 11. The cracks 19*c* extended in the rotating direction of the charging roller 19. Further, the coating film was formed on the surface of the resilient conductive layer 19*b* covering the cracks 19*c*. The minimum value of the crack depths was 60 μm.

<Printing Tests>

Printing tests were performed by mounting each of the charging rollers 19 of Samples 1 through 11 to the printer 1. As the printer 1, a color LED printer ("C711dn" manufactured by Oki Data Corporation) was used. Evaluation was performed at a start of printing operation and at an end of continuous printing operation.

The evaluation at the start of the printing operation was performed by printing an image on a sheet (i.e., a first sheet) after mounting the charging roller 19 to be tested to the printer 1, and checking a quality of the printed image.

Further, continuous printing operation on 3000 sheets per day was performed for 10 days. That is, continuous printing operation was performed on 30,000 sheets in total. The evaluation at the end of the continuous printing operation was performed by printing an image on a sheet after the continuous printing operation on 30,000 sheets, and checking a quality of the printed image.

The printing tests were performed in three environments: a normal-temperature-and-normal-humidity environment where a temperature is 24±4° C. and a humidity is 50±15% RH, a high-temperature-and-high-humidity environment where the temperature is 28° C. and the humidity is 85% RH, a low-temperature-and-low-humidity environment where the temperature is 10° C. and the humidity is 15% RH.

Two print patterns (images) were used in the printing tests. More specifically, a 5% coverage image and a "1 by 1" halftone image of 600 dpi are used. In this regard, the term "coverage" indicates a percentage of an area of a printed portion per unit area. For example, a solid image is a 100% coverage image, and the "1 by 1" halftone image is a 25% coverage image.

<Evaluation Results>

Next, the evaluation results will be described. If a defect was found in any one of the images (i.e., the 5% coverage image and the 1 by 1 halftone image) printed in the three environments, the evaluation result was "X" (poor). If no defect was found in the images printed in the three environments, the evaluation result was "0" (good).

When the charging rollers 19 of Samples 1 through 5 were used, no defect was found in the images printed at the start of the printing operation and at the end of the continuous printing operation. A reason thereof will be described later with reference to FIG. 9B.

When the charging roller 19 of Sample 6 was used, vertical strips and vertical belt-like patterns were found in the images printed at the end of the continuous printing operation. A reason thereof will be described below. In the resilient conductive layer 19*b* of sample 6, a compounding ratio of diene-based rubber (with respect to epichlorohydrin rubber) was relatively small. For this reason, a function of the oxide film 19*f* (as a protection film) formed on the surface of the resilient conductive layer 19*b* was not sufficiently obtained. Therefore, the surface of the resilient conductive layer 19*b* was scratched in the rotating direction by contact with the cleaning roller 20, with the result that the vertical strips and vertical belt-like patterns appeared on the printed image.

When the charging roller 19 of Sample 7 was used, the density unevenness was found in the images printed at the start of the printing operation. A reason thereof will be described below. In the resilient conductive layer 19*b* of sample 6, a compounding ratio of epichlorohydrin rubber (with respect to diene-based rubber) was relatively small. For this reason, a resistance value of the resilient conductive layer 19*b* was not sufficiently lowered. Due to the ion conductivity of the resilient conductive layer 19*b*, the resistance value of the resilient conductive layer 19*b* increased particularly in the low-temperature-and-low-humidity environment. A charging function of the charging roller 19 (i.e., a function to uniformly charge the surface of the photosensitive drum 11) was degraded by such a particularly high resistance value. Therefore, the charging roller 19 could not uniformly charge the surface of the photosensitive drum 11, with the result that density unevenness of the printed image occurred.

Since the evaluation result at the start of the printing operation was poor (X), the evaluation was not performed after the continuous printing operation.

When the charging rollers 19 of Samples 8 and 9 were used, lateral strips were found in the images printed at the end of the continuous printing operation. A reason thereof will be described below. As tips of ridges between the polishing grooves 19*g* of the resilient conductive layer 19*b* were worn by contact with the cleaning roller 20, the surface roughness of the resilient conductive layer 19*b* decreased. Therefore, portions where the resistance value was locally small appeared, with the result that the resistance value of the resilient conductive layer 19*b* became uneven.

Figure 9A:
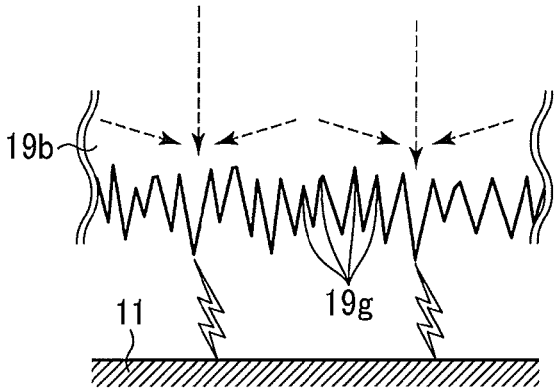
FIGS. 9A and 9B are explanation views for illustrating a discharging from the surface of the resilient conductive layer of the charging roller according to the embodiment of the present invention.
Figure 9B:
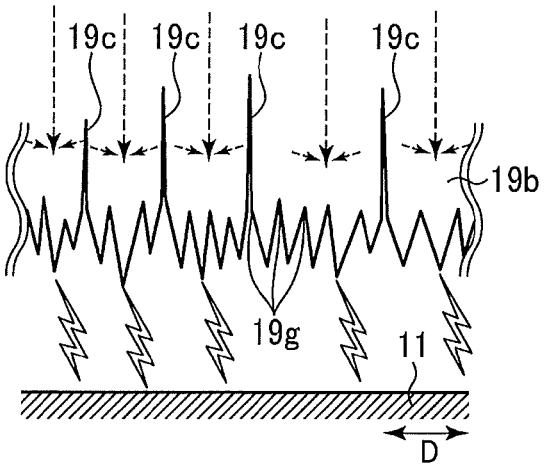

FIGS. 9A and 9B are schematic views for illustrating discharge from the surface of the resilient conductive layer 19*b*. FIG. 9A shows how discharge occurs from the surface of the resilient conductive layer 19*b* in the case where no crack is formed on the surface of the resilient conductive layer 19*b*. FIG. 9B shows how discharge occurs from the surface of the resilient conductive layer 19*b* in the case where cracks 19*c* are formed on the surface of the resilient conductive layer 19*b*.

As shown in FIG. 9A, in each of the charging roller 19 of Samples 18 and 19, no crack was formed on the surface of the resilient conductive layer 19*b*. When electrical charges were discharged from the surface of the resilient conductive layer 19*b* (so as to charge the surface of the photosensitive drum 11), discharge was likely to occur at a portion where a distance between the surface of the resilient conductive layer 19*b* and the surface of the photosensitive drum 11 was short. The electrical charges moved along the surface of the resilient conductive layer 19*b* as shown by dashed arrows, and there occurred a portion where discharge did not occur or was very weak. Therefore, the unevenness of the charging potential occurred on the surface of the photosensitive drum 11, with the result that the lateral stripes were formed on the printed image.

In contrast, as shown in FIG. 9B, in each of the charging roller 19 of Samples 1 through 5, the cracks 19*c* were formed on the surface of the resilient conductive layer 19*b*. Even in these cases, tips of ridges between the polishing grooves 19*g* of the resilient conductive layer 19*b* may be worn by contact with the cleaning roller 20 (i.e., the surface roughness of the resilient conductive layer 19*b* may decrease), so that a portion where the resistance value was locally small may appear as in Samples 8 and 9. However, since the cracks 19*c* were formed on the surface of the resilient conductive layer 19*b*, the electric charges were less likely to move along the surface of the resilient conductive layer 19*b*. In other words, the cracks 19*c* functioned as high resistance regions suppressing movement of the electric charges in the axial direction of the charging roller 19 (indicated by the arrow D) along the surface of the resilient conductive layer 19*b*. Therefore, the unevenness of the charging potential did not occur, and the charging roller 19 uniformly charged the surface of the resilient conductive layer 19*b*.

When the images printed using the charging rollers 19 of Samples 8 and 9 were compared with each other, the image printed using the charging roller 19 of Sample 8 was better than the image printed using the charging roller 19 of Sample 8. Although the image printed using the charging roller 19 of Sample 8 was not at a satisfactory level, it is understood that degradation of the printing quality was restricted to some extent because the cracks 19*c* were formed on the surface of the resilient conductive layer 19*b* of Sample 8.

When the charging roller 19 of Sample 10 was used, lateral strips were found in the images printed after the continuous printing operation. A reason thereof will be described below. That is, the coating film formed on the surface of the resilient conductive layer 19*b* was harder than the oxide film 19*f* (of the charging rollers 19 of Samples 1 through 5) formed by the UV irradiation of the rubber. Therefore, an amount of wear of the surface of the resilient conductive layer 19*b* was small, and filming occurred at the surface of the resilient conductive layer 19*b* by contact with the cleaning roller 20.

Therefore, there occurred a portion on the surface of the resilient conductive layer 19*b* where the resistance value is locally high. That is, the resistance value on the surface of the resilient conductive layer 19*b* became uneven, and lateral strips appeared in the printed images as in Samples 8 and 9.

When the charging roller 19 of Sample 11 was used, the density unevenness was found in the images printed in the low-temperature-and-low-humidity environment at the start of the printing operation. A reason thereof will be described below. That is, since the coating film was formed on the cracks 19*c* on the surface of the resilient conductive layer 19*b* by the UV irradiation, the total thickness of the resilient conductive layer 19*b* increased. As the thickness of the resilient conductive layer 19*b* increases, the resistance value at the surface of the resilient conductive layer 19*b* also increases. Further, due to the ion conductivity of the resilient conductive layer 19*b*, the resistance value of the resilient conductive layer 19*b* increases particularly in the low-temperature-and-low-humidity environment. The charging function of the charging roller 19 was degraded by the particularly high resistance value. For these reasons, the density unevenness of the printed image occurs.

Regarding Sample 11, since the evaluation result at the start of the printing operation is poor (X), the evaluation is not performed after the continuous printing operation.

CONCLUSION

As a result, it is understood that the surface of the photosensitive drum 11 can be uniformly charged by providing cracks 19*c* on the surface of the resilient conductive layer 19*b*. To be more specific, the surface of the photosensitive drum 11 can be uniformly charged by providing at least one crack 19*c* (whose depth from the surface of the resilient conductive layer 19*b* is greater than or equal to 20 μm) per unit area (1 $mm^2$) on the surface of the resilient conductive layer 19*b*. Therefore, the degradation of printing quality can be suppressed.

The minimum value of the crack depths is preferably in a range from 20 to 200 μm.

Further, the resilient conductive layer 19*b* contains epichlorohydrin rubber and diene-based rubber. The composition ratio of epichlorohydrin rubber to diene-based rubber is preferably in a range from 80/20 (i.e., 80 weight parts of epichlorohydrin rubber and 20 weight parts of diene-based rubber) to 40/60 (i.e., 40 weight parts of epichlorohydrin rubber and 60 weight parts of diene-based rubber). In other words, the amount of the diene-based rubber is preferably in a range from 25 weight parts to 150 weight parts, with respect to 100 weight parts of epichlorohydrin rubber. With such a composition, it becomes possible to prevent decrease in function of the protection film (i.e., the oxide film 19*f*) on the surface of the resilient conductive layer 19*b* due to the UV irradiation, and it becomes possible to prevent degradation of the printing quality.

Further, from the evaluation result of Sample 11, it is preferred that no layer (that causes an increase in resistance value and impairs the charging function) is formed on the surface of the resilient conductive layer 19*b* having the cracks 19*c*.

Advantage of Embodiment

As described above, according to the embodiment of the present invention, the charging potential on the surface of the photosensitive drum can be made even by providing the cracks 19*c* on the surface of the resilient conductive layer of the charging roller. Accordingly, degradation of the printing quality can be prevented.

In the above described embodiment, the cracks 19*c* have been described as an example of the high resistance regions. However, the high resistance regions are not limited to the cracks 19*b*. It is also possible to use other high resistance regions as long as the high resistance regions suppress the movement of the electric charges along the surface of the resilient conductive layer 19*b*.

In the above described embodiment, the printer has been described as an example of the image forming apparatus. However, the present invention is not limited to the printer, but is applicable to various types of image forming apparatuses using electrophotography such as a facsimile machine, a copier a multifunction peripheral or the like.

While the preferred embodiments of the present invention have been illustrated in detail, it should be apparent that modifications and improvements may be made to the invention without departing from the spirit and scope of the invention as described in the following claims.

What is claimed is:

1. A charging device comprising:

a charging member that charges a surface of an image bearing body;

wherein the charging member includes a rotation shaft applied with a voltage, and a resilient conductive layer provided on an outer circumferential surface of the rotation shaft, the resilient conductive layer having a plurality of grooves on a surface thereof;

wherein the resilient conductive layer further has a plurality of cracks formed at valleys of the grooves; and wherein the cracks extend in a rotating direction of the charging member, and are arranged at intervals in an axial direction of the rotation shaft.

2. The charging device according to claim 1, wherein:

the cracks have a depth greater than or equal to 20 μm from the surface of the resilient conductive layer; and at least five cracks are provided in an area of 5 $mm^2$ on the surface of the resilient conductive layer parallel to the axial direction.

3. The charging device according to claim 1, wherein:

the cracks have a depth greater than or equal to 20 μm from the surface of the resilient conductive layer; and at least one crack is provided in an area of 1 $mm^2$ on the surface of the resilient conductive layer parallel to the axial direction.

4. The charging device according to claim 1, wherein the cracks are formed by irradiating the surface of the resilient conductive layer with ultraviolet rays.

5. The charging device according to claim 1, wherein the grooves extend in the rotational direction of the charging member.

6. The charging device according to claim 1, wherein:

a protection film is formed on the surface of the resilient conductive layer; and the cracks are formed in the protection film.

7. The charging device according to claim 6, wherein the protection film is an oxide film.

8. The charging device according to claim 6, wherein a protection film covers surfaces of the cracks.

9. The charging device according to claim 1, wherein the voltage applied to the rotation shaft is a direct voltage.

10. The charging device according to claim 1, wherein the resilient conductive layer contains 20 weight parts or more of diene-based rubber with respect to 100 weight parts epichlorohydrin rubber.

11. The charging device according to claim 1, wherein the resilient conductive layer contains 150 weight parts or less of diene-based rubber with respect to 100 weight parts epichlorohydrin rubber.

12. An image forming unit comprising the charging device according to claim 1.

13. An image forming apparatus comprising the charging device according to claim 1.

14. The charging device according to claim 1, wherein the cracks do not cross each other.

15. The charging device according to claim 1, wherein the grooves have a maximum height roughness Ry of between 1 μm and 40 μm.

* * * * *